US006311673B1

(12) United States Patent
Hotta et al.

(10) Patent No.: US 6,311,673 B1
(45) Date of Patent: Nov. 6, 2001

(54) FUEL INJECTION DEVICE

(75) Inventors: Kazuhito Hotta; Kenichiro Ikeda; Shunji Akamatsu; Mutsumi Katayama, all of Saitama (JP)

(73) Assignee: Honda Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/527,025

(22) Filed: Mar. 16, 2000

(30) Foreign Application Priority Data

Mar. 16, 1999 (JP) ..... 11-069579

(51) Int. Cl.[7] ..... F02M 33/04
(52) U.S. Cl. ..... 123/456; 123/457
(58) Field of Search ..... 123/456, 468, 123/469, 470, 457; 137/510, 550

(56) References Cited

U.S. PATENT DOCUMENTS 5,086,743 * 2/1992 Hickey ..... 123/456
5,094,211 * 3/1992 Mahnke et al. ..... 123/456
5,143,039 * 9/1992 Gmelin ..... 123/456
5,163,468 * 11/1992 Robinson et al. ..... 137/550
5,233,963 * 8/1993 Gregorius et al. ..... 123/456
5,320,078 * 6/1994 Lorraine ..... 123/456
5,390,638 * 2/1995 Hornby et al. ..... 123/456
5,413,077 * 5/1995 Hornby et al. ..... 123/463
5,429,094 * 7/1995 Akiba et al. ..... 137/510
5,445,130 * 8/1995 Brummer et al. ..... 123/456
5,577,478 * 11/1996 Tuckey ..... 123/456
6,148,798 * 11/2000 Braun et al. ..... 123/456

FOREIGN PATENT DOCUMENTS

B2-2849800 11/1998 (JP) .

* cited by examiner

*Primary Examiner*—Thomas N. Moulis
(74) *Attorney, Agent, or Firm*—Birch, Stewart, Kolasch & Birch, LLP.

(57) ABSTRACT

A fuel injection device for an engine constructed at a cost reduction by rational integral formation of a fuel supply pipe and a part of an injection pressure regulator. A regulator housing of an injection pressure regulator is divided into a housing body defining a fuel chamber and a cover defining a pressure regulating chamber. The housing body is integral with a fuel supply pipe at its end portion. The fuel supply pipe is connected at its side wall to a fuel injector.

12 Claims, 15 Drawing Sheets

FUEL INJECTION DEVICE

BACKGROUND OF THE INVENTION

1. Field of the Invention

The present invention relates to a fuel injection device for supplying fuel to an engine, and more particularly to an improvement in a fuel injection device including a fuel supply pipe; a fuel feed pipe communicating with a fuel pump and connected to one end portion of the fuel supply pipe; an injection pressure regulator provided at the other end portion of the fuel supply pipe, the injection pressure regulator includes a regulator housing, a diaphragm partitioning the regulator housing into a fuel chamber communicating with the fuel supply pipe and a pressure regulating chamber, pressure regulating biasing means provided in the pressure regulating chamber for biasing the diaphragm toward the fuel chamber, valve means adapted to close at a limit of displacement of the diaphragm toward the fuel chamber and to open in concert with displacement of the diaphragm from the limit toward the pressure regulating chamber, and a fuel return outlet communicating with the fuel chamber through the valve means; and a fuel injector fitted with a supply hole formed through a circumferential wall of the fuel supply pipe.

2. Description of Background Art

A fuel injection device is disclosed in Japanese Patent No. 2849800 wherein the prior art fuel injection device, a fuel supply pipe and a regulator housing of an injection pressure regulator are separate members that are joined by special connecting means. Accordingly, the number of parts is large and it is difficult to reduce the cost. Particularly in the case of a fuel injection device for a single-cylinder engine, the ratio of the cost for the injection pressure regulator and the connecting means to the cost for the whole device is large, so that cost reduction is more difficult to achieve.

SUMMARY AND OBJECTS OF THE INVENTION

It is accordingly an object of the present invention to provide a fuel injection device which can be produced with a greatly reduced number of parts to thereby achieve a cost reduction by rational integral formation of the fuel supply pipe and a part of the injection pressure regulator.

According to a first aspect of the present invention, a fuel injection device is provided that includes a fuel supply pipe; a fuel feed pipe communicating with a fuel pump and connected to one end portion of the fuel supply pipe; an injection pressure regulator provided at the other end portion of the fuel supply pipe, the injection pressure regulator includes a regulator housing, a diaphragm partitioning the regulator housing into a fuel chamber communicating with the fuel supply pipe and a pressure regulating chamber. Pressure regulating biasing means are provided in the pressure regulating chamber for biasing the diaphragm toward the fuel chamber. Valve means are adapted to close at a limit of displacement of the diaphragm toward the fuel chamber and to open in concert with displacement of the diaphragm from the limit toward the pressure regulating chamber, and a fuel return outlet communicating with the fuel chamber through the valve means. A fuel injector is fitted with a supply hole formed through a circumferential wall of the fuel supply pipe. The regulator housing is divided into a housing body defining the fuel chamber therein and a cover defining the pressure regulating chamber, and the housing body is provided that is integral with the fuel supply pipe.

With this configuration, the fuel supply pipe and the housing body are integrally formed, so that it is not necessary to provide any connecting means for connecting the fuel supply pipe and the regulator housing as in the prior art, thus greatly reducing the number of parts in the fuel injection device to thereby achieve the cost reduction.

According to a second aspect of the present invention, the valve means comprises a valve seat formed in the fuel supply pipe and a valve element attached to the diaphragm and adapted to be seated on the valve seat, and the fuel return outlet communicating with the valve seat is integral with the fuel supply pipe.

With this configuration, the fuel supply pipe and the fuel return outlet are also integrally formed, so that the number of parts can be further reduced to thereby achieve a further reduction in cost.

According to a third aspect of the present invention, there is provided in a fuel injection device including a fuel supply pipe; a fuel feed pipe communicating with a fuel pump and connected to one end portion of the fuel supply pipe and an injection pressure regulator provided at the other end portion of the fuel supply pipe. The injection pressure regulator includes a regulator housing, a diaphragm partitioning the regulator housing into a fuel chamber communicating with the fuel supply pipe and a pressure regulating chamber. A pressure regulating biasing means is provided in the pressure regulating chamber for biasing the diaphragm toward the fuel chamber. Valve means are adapted to close at a limit of displacement of the diaphragm toward the fuel chamber and to open in concert with displacement of the diaphragm from the limit toward the pressure regulating chamber, and a fuel return outlet communicating with the fuel chamber through the valve means; and a fuel injector fitted with a supply hole formed through a circumferential wall of the fuel supply pipe. The fuel supply pipe is formed from an extruded member; the regulator housing includes a housing body defining the fuel chamber therein and formed at the other end portion of the fuel supply pipe, a valve seat housing mounted in the housing body and formed from an extruded member, and a cover defining the pressure regulating chamber therein and joined to the housing body with the diaphragm held between the housing body and the cover; the valve seat housing includes a cylindrical wall fitted with an inner circumferential surface of the housing body and an arm projecting from an inner circumferential surface of the cylindrical wall to a radially central portion thereof. The valve means includes a valve seat formed on the arm so as to be exposed to the fuel chamber, and a valve element attached to the diaphragm and adapted to be seated on the valve seat. The arm is formed with a radial communication hole for communicating between the valve seat and the fuel return outlet fixed to the housing body.

With this configuration, the fuel supply pipe and the housing body are integrally formed, so that it is not necessary to provide any connecting means for connecting the fuel supply pipe and the regulator housing as in the prior art, thereby greatly reducing the number of parts in the fuel injection device to result in cost reduction. Moreover, the fuel supply pipe and the valve seat housing are formed from the respective extruded members, so that a further reduction in cost can be achieved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Some preferred embodiments of the present invention will now be described with reference to the attached drawings. The first preferred embodiment of the present invention will now be described with reference to FIGS. 1 to 4.

Figure 1:
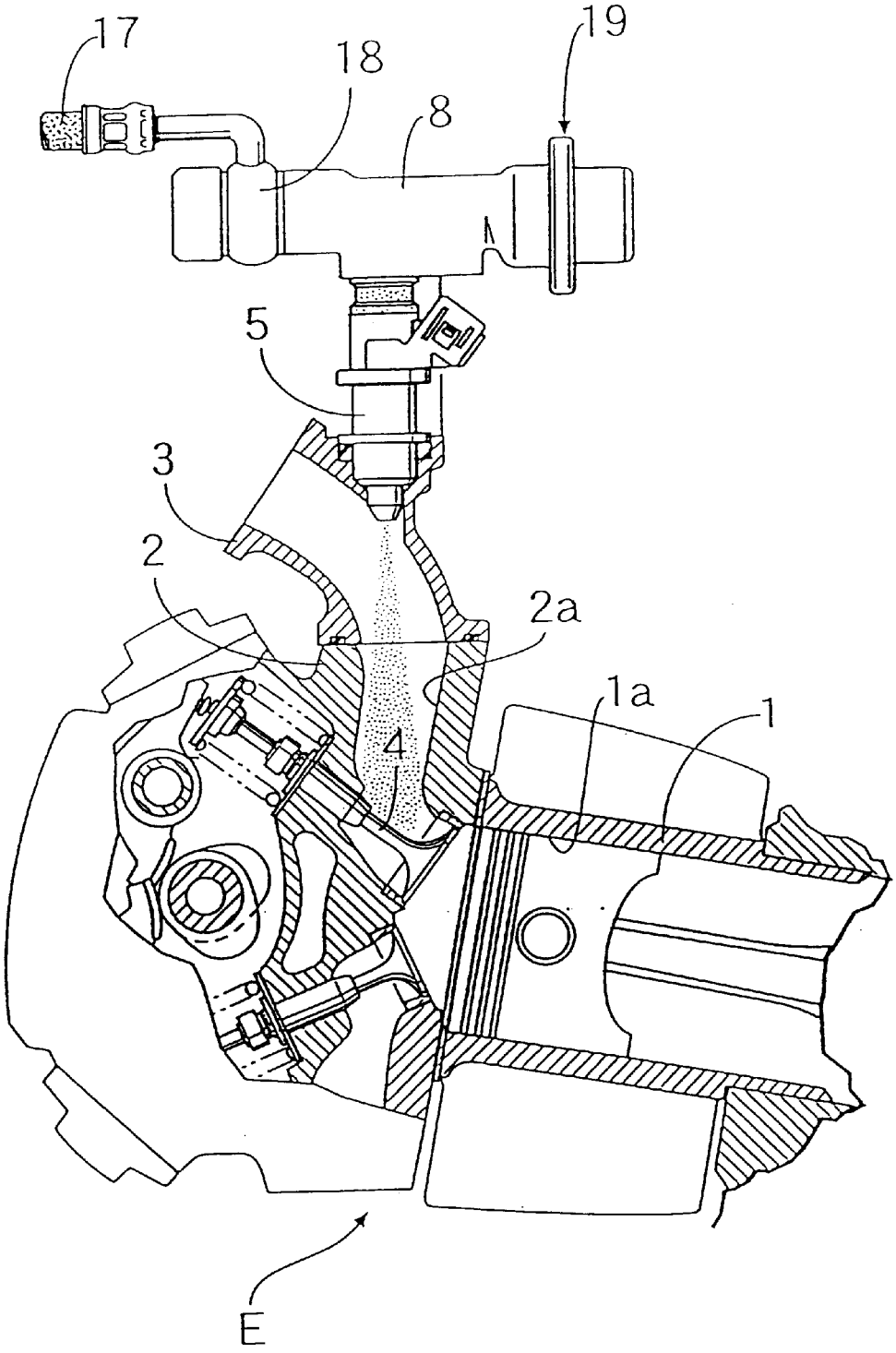
FIG. 1 is a vertically sectional side view of an essential part of a single-cylinder engine to which a fuel injection device according to a first preferred embodiment of the present invention is applied.

Referring to FIG. 1, reference symbol E denotes a single-cylinder engine for a small-sized motorcycle. A cylinder block 1 of the engine E is laid substantially horizontally, and a cylinder head 2 having an intake port 2*a* therein is joined to a front end surface of the cylinder block 1. An intake pipe 3 communicating with the intake port 2*a* is joined to an upper surface of the cylinder head 2. Air filtered by an air cleaner (not shown) is induced through the intake pipe 3, the intake port 2*a*, and an intake valve 4 into a single cylinder bore 1*a* of the cylinder block 1. An electromagnetic fuel injector 5 for injecting fuel toward an outlet of the intake port 2*a* is mounted on the intake pipe 3, and a fuel supply pipe 8 is mounted on the upper end of the fuel injector 5.

Figure 2:
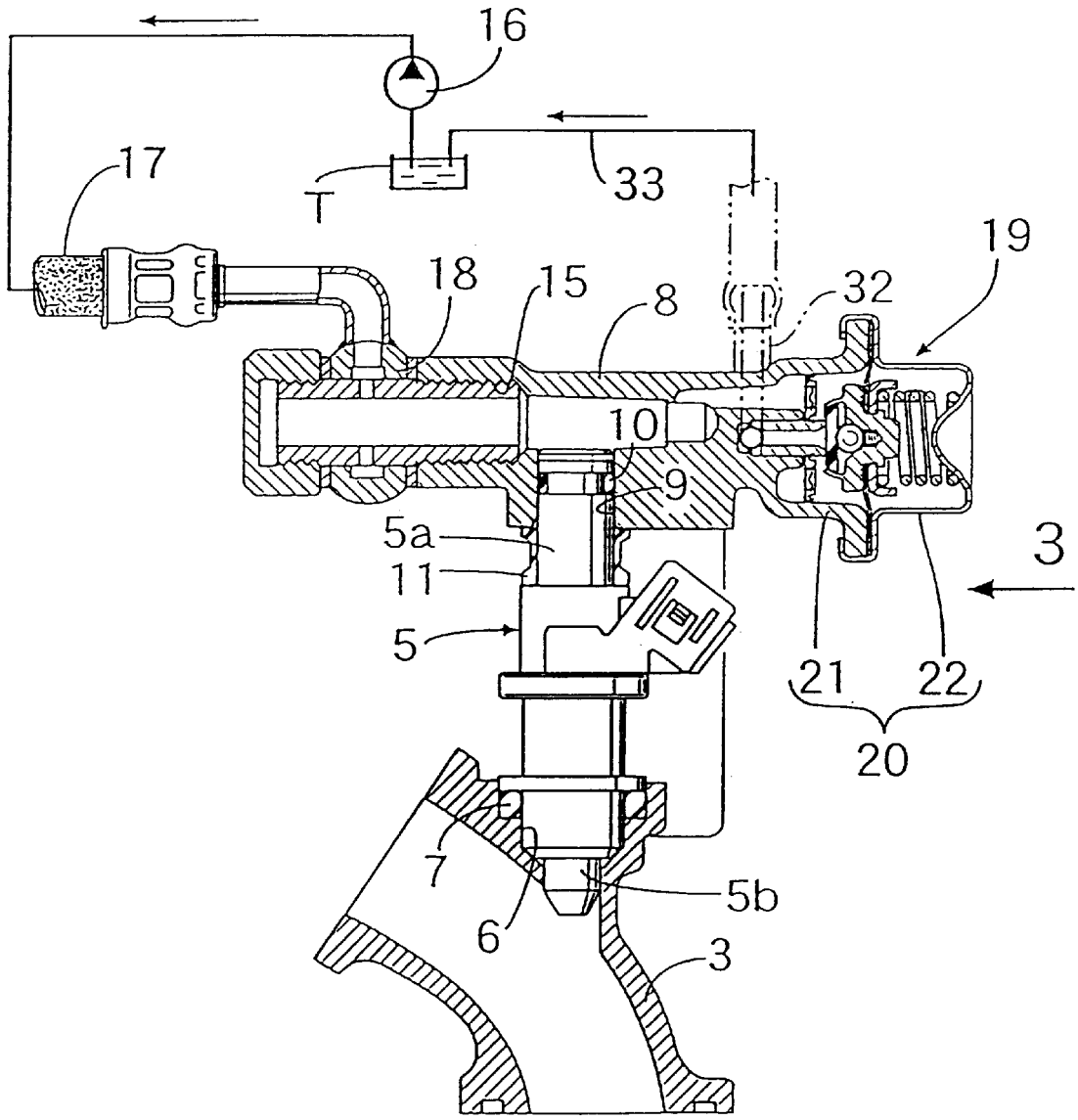
FIG. 2 is an enlarged, vertically sectional side view of the fuel injection device shown in FIG. 1.
Figure 3:
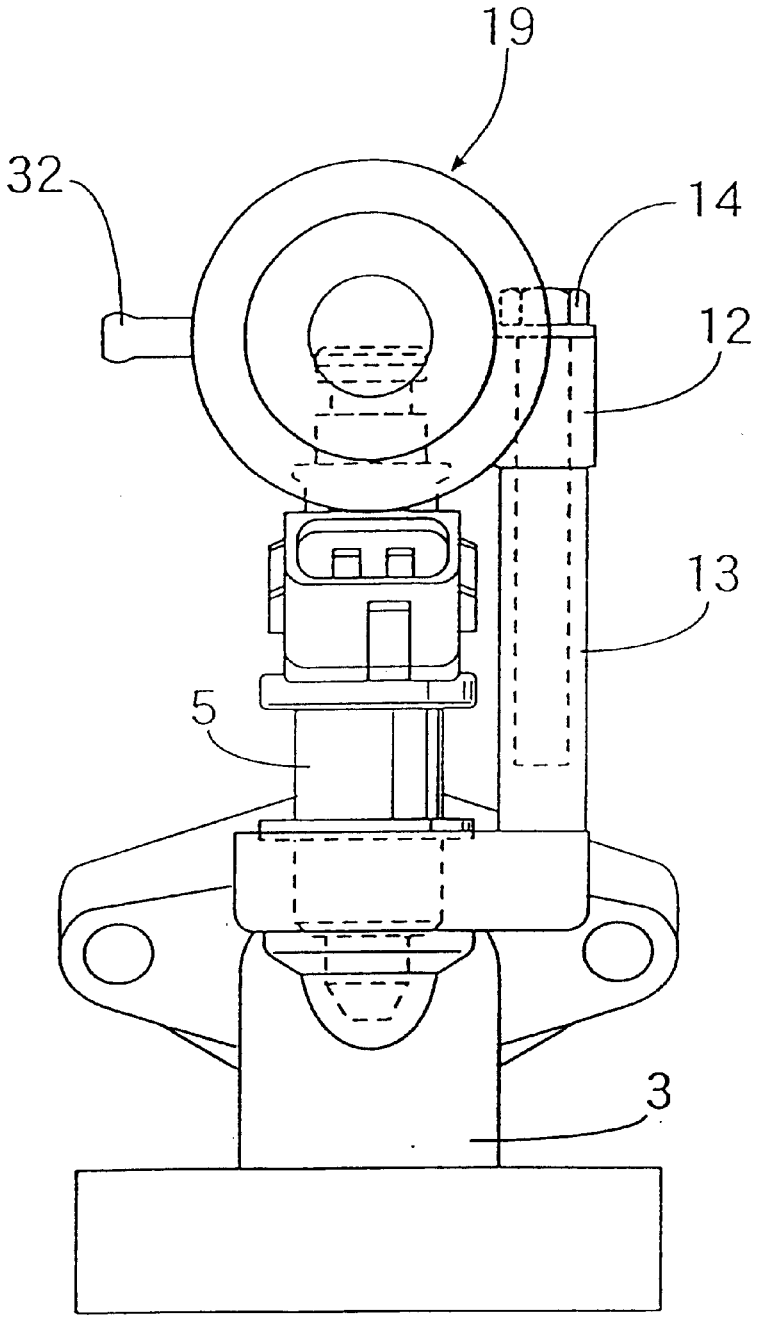
FIG. 3 is an end view taken in the direction shown by an arrow 3 in FIG. 2.

As shown in FIGS. 2 and 3, the intake pipe 3 is formed at its upper wall with a stepped mounting hole 6 communicating with the inside passage of the intake pipe 3, and a lower fuel outlet portion 5*b* of the fuel injector 5 is fitted with the stepped mounting hole 6 of the intake pipe 3 through a seal member 7.

The fuel supply pipe 8 is formed at its lower wall with a radially extending supply hole 9. The supply hole 9 of the fuel supply pipe 8 is fitted with an upper fuel inlet portion 5*a* of the fuel injector 5 through a seal member 10. Further, an elastic collar 11 for urging the fuel injector 5 toward the stepped mounting hole 6 is interposed between the fuel injector 5 and the fuel supply pipe 8. As is apparent from FIG. 3, a mounting boss 12 projects from one side of the fuel supply pipe 8, and a supporting boss 13 projects upward from the intake pipe 3. The fuel supply pipe 8 is supported to the intake pipe 3 by fixing the mounting boss 12 to the supporting boss 13 by means of a bolt 14.

The fuel supply pipe 8 is formed at its one end portion with a connection hole 15. A fuel feed pipe 17 communicating with a discharge port of a fuel pump 16 is connected through a joint 18 to the connection hole 15 of the fuel supply pipe 8.

Figure 4:
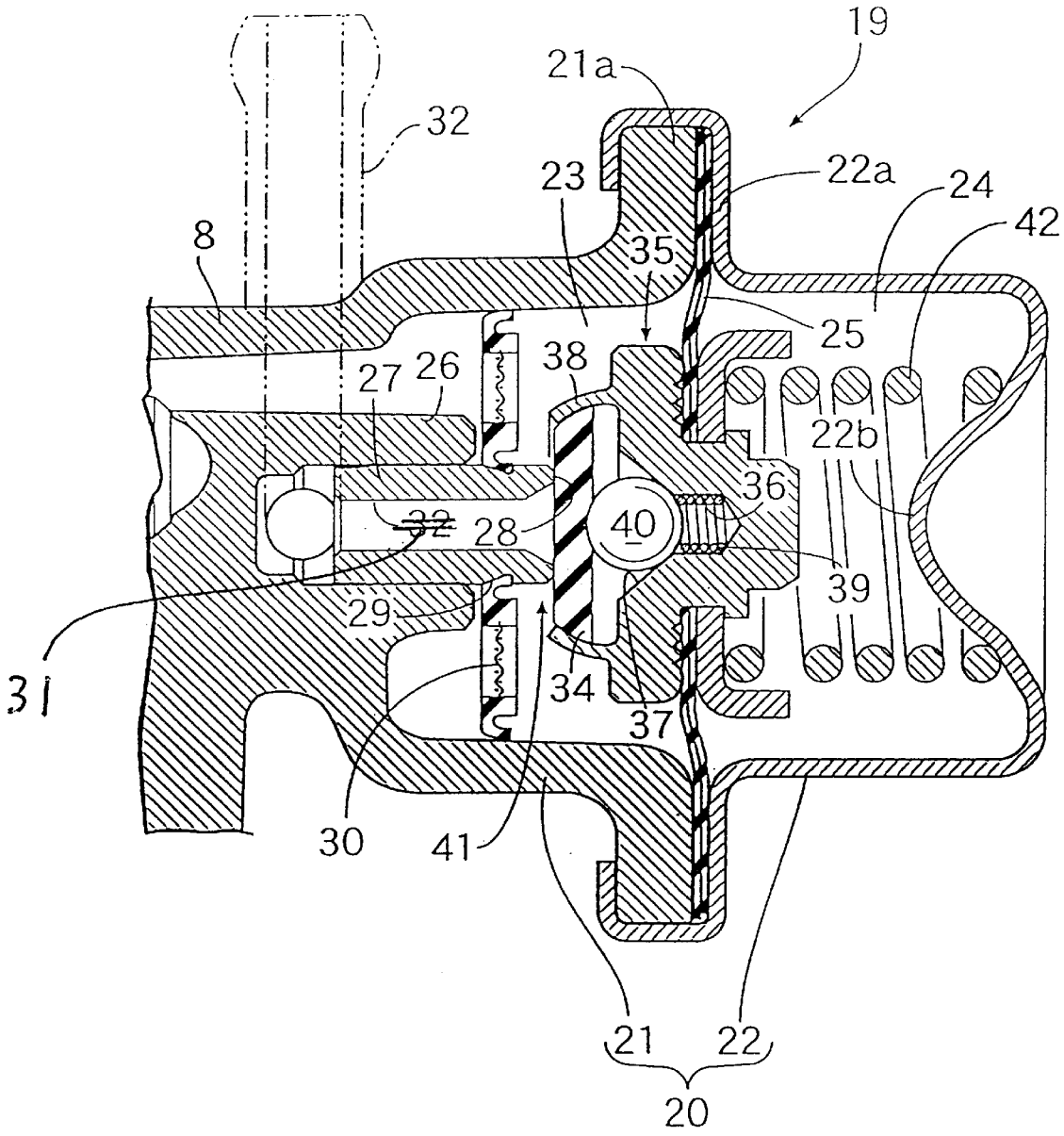
FIG. 4 is an enlarged, vertically sectional view of an injection pressure regulator in the fuel injection device shown in FIG. 1.

As shown in FIG. 4, an injection pressure regulator 19 for regulating a fuel injection pressure of the fuel injector 5 is provided at the other end portion of the fuel supply pipe 8. The injection pressure regulator 19 has a regulator housing 20. The regulator housing 20 consists of a cylindrical housing body 21 and a cylindrical cover 22 joined to the housing body 21. The housing body 21 is formed integrally with the fuel supply pipe 8 at its other end portion so as to be radially expanded. The cover 22 is formed by pressing a cylindrical member having a closed bottom. The housing body 21 is integrally formed at its open end with a flange 21*a*, and the cover 22 is integrally formed at its open end with a flange 22*a*. The flanges 21*a* and 22*a* are joined together by holding the flange 21*a* with the flange 22*a* and crimping the flange 22*a*. A fuel chamber 23 communicating with the fuel supply pipe 8 is defined in the housing body 21, and a pressure regulating chamber 24 is defined in the cover 22. A diaphragm 25 for partitioning the fuel chamber 23 and the pressure regulating chamber 24 is held between the flanges 21*a* and 22*a*.

The fuel supply pipe 8 is further integrally formed with a boss 26 axially projecting into the fuel chamber 23 at its central portion. A cylindrical valve seat member 27 having a valve seat 28 at its front end is fixed in the boss 26 by insert or press fit in such a manner that the valve seat 28 projects from the front end of the boss 26 into the fuel chamber 23. An annular groove 29 is formed on the outer circumference of the valve seat member 27, and an annular fuel filter 30 is engaged at its inner circumference with the annular groove 29 so that the outer circumference of the fuel filter 30 is closely fitted with the inner circumference of the fuel chamber 23.

The fuel supply pipe 8 is further integrally formed with a fuel return outlet 32 communicating with a valve hole 31 formed in the valve seat member 31 of the cylindrical valve seat member 27. The fuel return outlet 32 projects radially from the outer circumference of the fuel supply pipe 8, and a fuel return pipe 33 is connected at one end portion thereof to the fuel return outlet 32. The other end of the fuel return pipe 33 is open to a fuel tank T (see FIG. 2).

A valve retainer 35 for retaining a plate like valve element 34 adapted to be seated on the valve seat 28 is fixed to a central portion of the diaphragm 25 by crimping. The valve retainer 35 is formed with a cylindrical recess 36 opening to the fuel chamber 23 side, a conical recess 37 is continuous to the open end of the cylindrical recess 36, and an annular retaining wall 38 projecting from a peripheral portion of the conical recess 37 so as to be spherically tapered. A coil spring 39 is disposed in the cylindrical recess 36, and a fulcrum ball 40 is disposed in the conical recess 37 so as to be kept in contact with the coil spring 39. Further, the valve element 34 is disposed in the annular retaining wall 38 so as to be kept in contact with the fulcrum ball 40. The spherical inner surface of the annular retaining wall 38 is formed by a part of a spherical surface concentric with the fulcrum ball 40 disposed in the conical recess 37, and the valve element 34 is swingably supported by the spherical inner surface of the annular retaining wall 38 and the fulcrum ball 40. The fulcrum ball 40 is normally biased against the valve element 34 by the coil spring 39. Accordingly, even if the axis of the valve seat member 27 is somewhat inclined, the valve element 34 can be reliably seated on the valve seat 28. The valve element 34 and the valve seat member 27 having the valve seat 28 constitute valve means 41.

A pressure regulating spring 42 (pressure regulating biasing means) for biasing the diaphragm 25 to the fuel chamber 23 side under a given set load is accommodated in the pressure regulating chamber 24. The pressure regulating spring 42 has a fixed end supported by a curved projection 22*b* formed by raising the closed end of the cover 22 inward of the pressure regulating chamber 24. The set load of the pressure regulating spring 42 can be adjusted by adjusting the size of the curved projection 22*b*.

As described above, the fuel supply pipe 8, the housing body 21, the boss 26, and the fuel return outlet 32 are integrally formed by a suitable method such as casting or injection molding of resin.

The operation of the first preferred embodiment will now be described.

During the operation of the engine E, the fuel in the fuel tank T is supplied under pressure by the fuel pump 16 through the fuel feed pipe 17 and the fuel supply pipe 8 to the fuel chamber 23 of the injection pressure regulator 19. The fuel pressure is applied to the diaphragm 25 in a direction of separating the valve element 34 from the valve seat 28, i.e., in a direction of opening the valve element 34. On the other hand, the pressure regulating spring 42 in the pressure regulating chamber 24 biases the diaphragm 25 under the given set load in a direction of closing the valve element 34. Accordingly, when the fuel pressure in the fuel chamber 23 is less than or equal to a given value, the diaphragm 25 is moved to the fuel chamber 23 side until the valve element 34 is seated on the valve seat 28 by the load of the pressure regulating spring 42 to thereby maintain a valve open condition of the valve element 34, whereas when the fuel pressure in the fuel chamber 23 becomes greater than the given value, the diaphragm 25 is moved to the pressure regulating chamber 24 side to separate the valve element 34 from the valve seat 28, thus opening the valve element 34. When the valve element 34 is opened, a part of the fuel in the fuel chamber 23 is returned through the opened valve hole 31, the fuel return outlet 32, and the fuel return pipe 33 to the fuel tank T. As a result, the fuel pressure in the fuel chamber 23 is returned to the given value, and the diaphragm 25 is accordingly moved to the fuel chamber 23 side to close the valve element 34. Such an operation is repeated to automatically regulate the fuel pressure in the fuel chamber 23, i.e., the fuel injection pressure of the fuel injector 5 to the given value corresponding to the set load of the pressure regulating spring 42.

In the fuel injection device according to the first preferred embodiment, the housing body 21 of the regulator housing 20 is integral with the fuel supply pipe 8, so that the housing body 21 need not be individually produced. Furthermore, means for connecting the fuel supply pipe 8 and the regulator housing 20 as used in the prior art is not required. Accordingly, the number of parts of the fuel injection device can be greatly reduced to thereby greatly reduce the cost.

Moreover, the boss 26 and the fuel return outlet 32 are also integral with the fuel supply pipe 8, thereby further reducing the number of parts to achieve a further reduction in cost.

Figure 5:
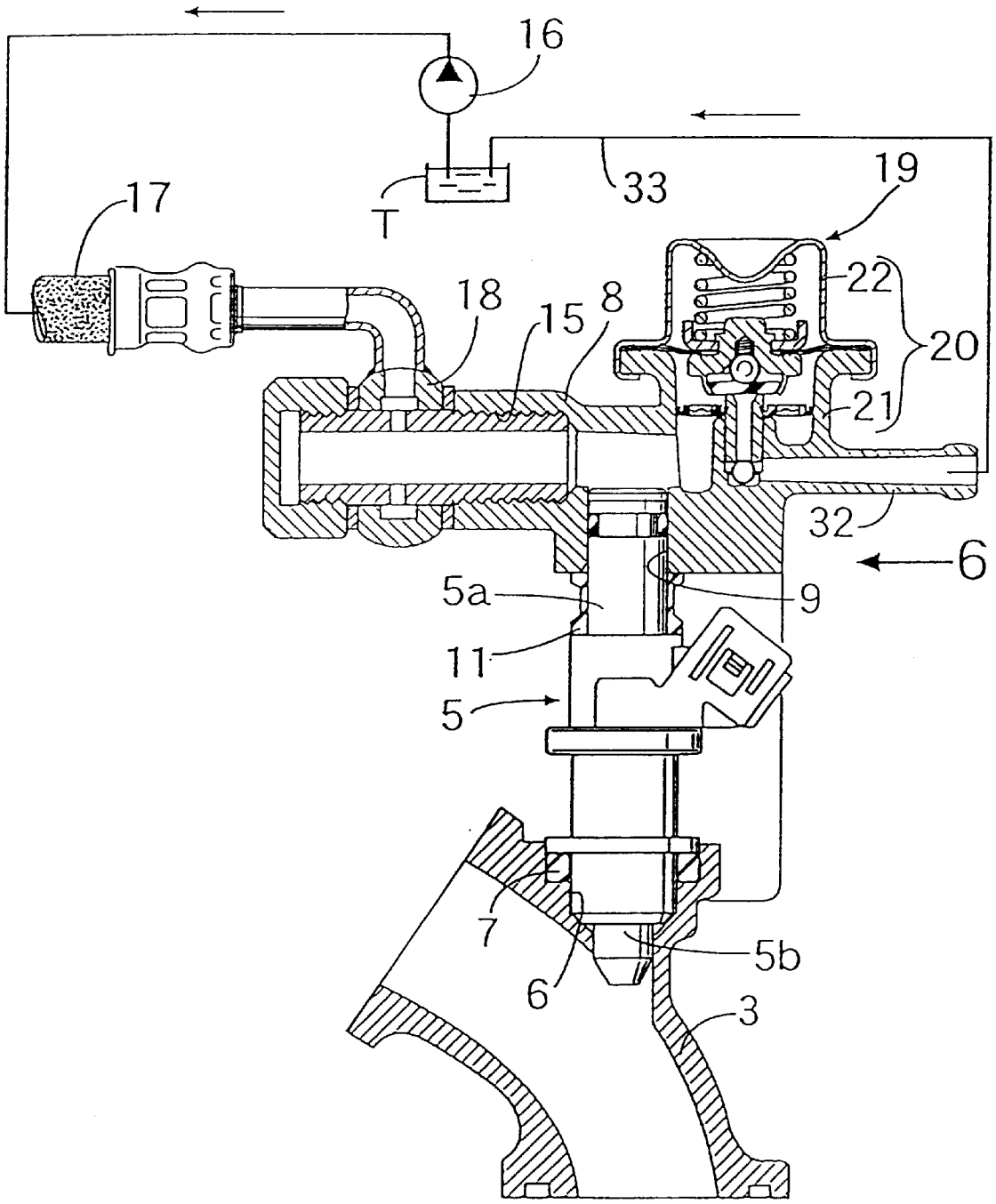
FIG. 5 is a sectional view similar to FIG. 2, showing a second preferred embodiment of the present invention.
Figure 6:
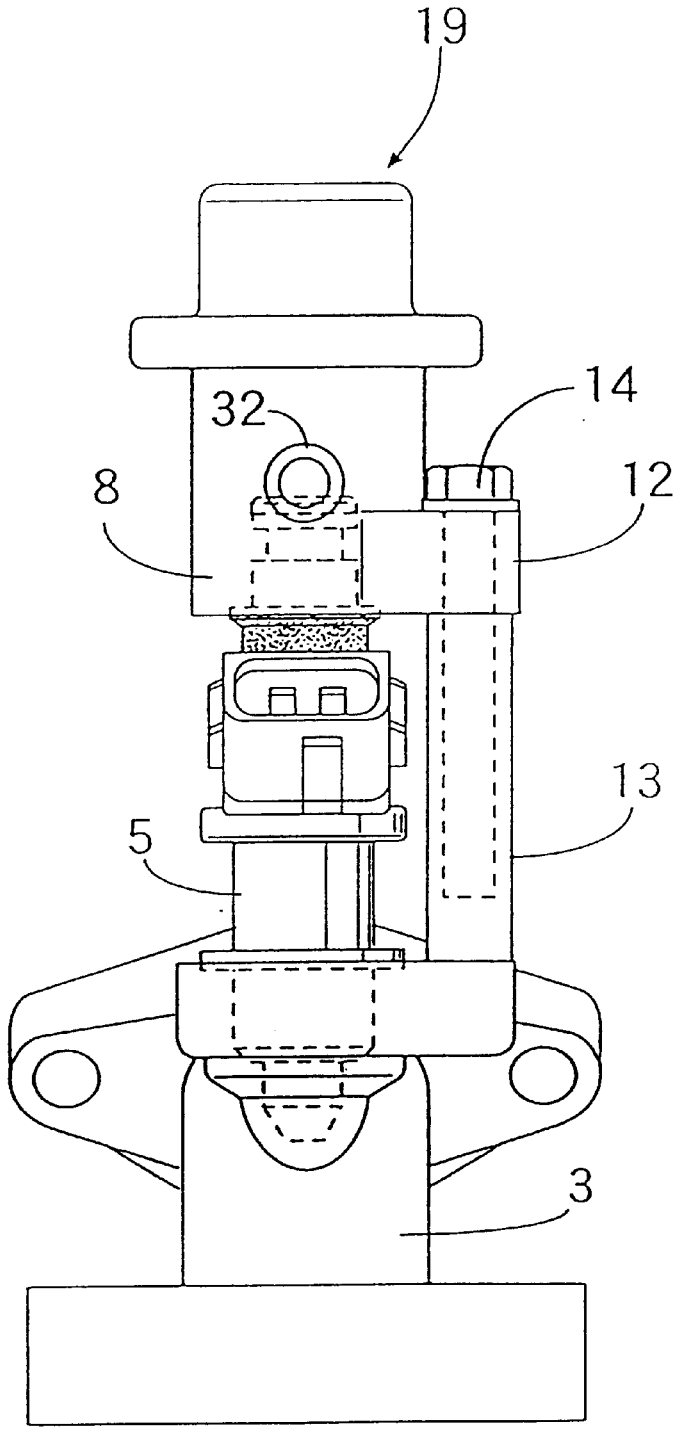
FIG. 6 is an end view taken in the direction shown by an arrow 6 in FIG. 5.

A second preferred embodiment of the present invention will now be described with reference to FIGS. 5 and 6.

The second preferred embodiment is different from the first preferred embodiment in that the injection pressure regulator 19 projects radially outward from the outer circumference of the fuel supply pipe 8 near an end surface thereof and that the fuel return outlet 32 projects axially from the end surface of the fuel supply pipe 8. The other configuration is similar to that of the first preferred embodiment, and corresponding parts are denoted by the same reference numerals in FIGS. 5 and 6, whose description will be omitted herein.

Figure 7:
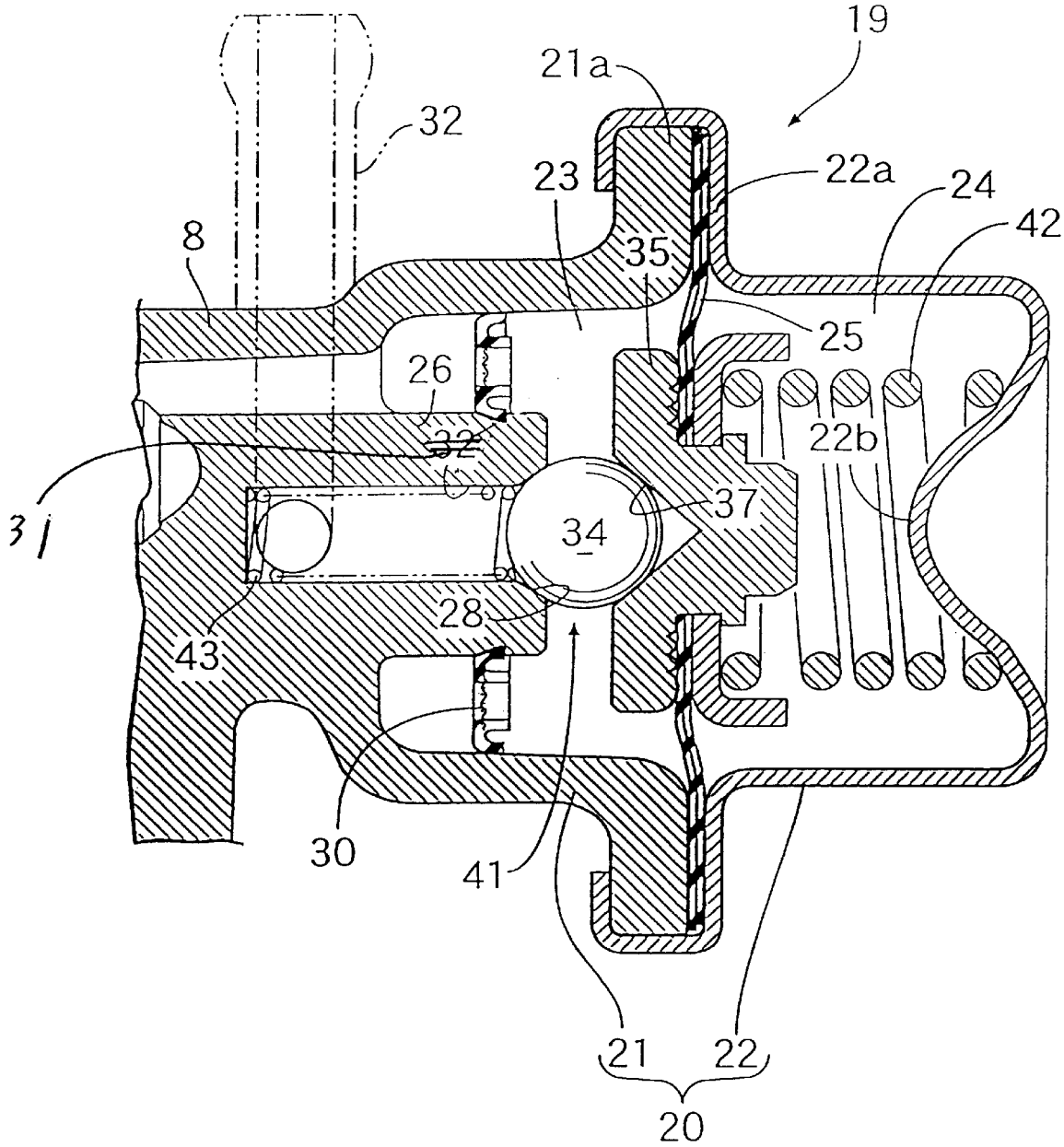
FIG. 7 is a sectional view similar to FIG. 4, showing a third preferred embodiment of the present invention.
Figure 8:
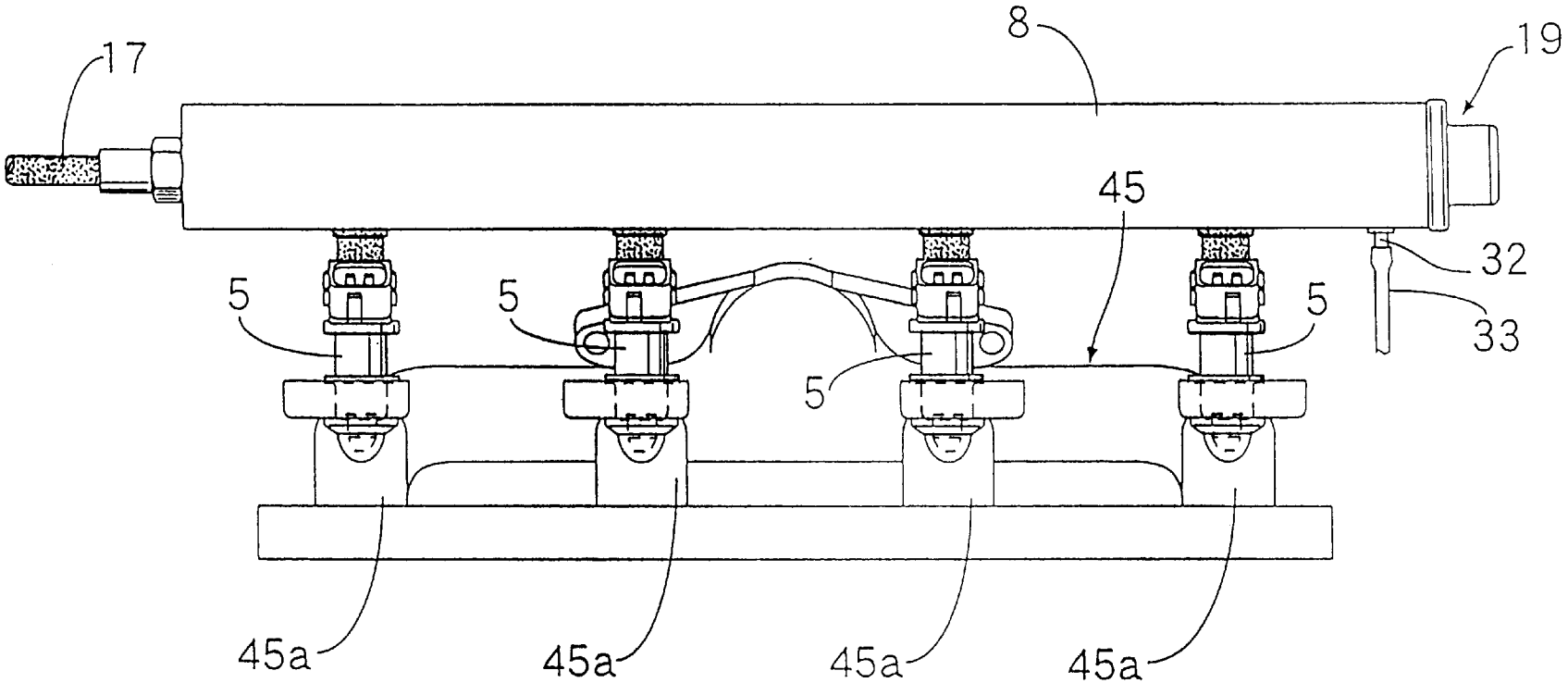
FIG. 8 is an elevational view of an essential part of a multicylinder engine to which a fuel injection device according to a fourth preferred embodiment of the present invention is applied.
Figure 9:
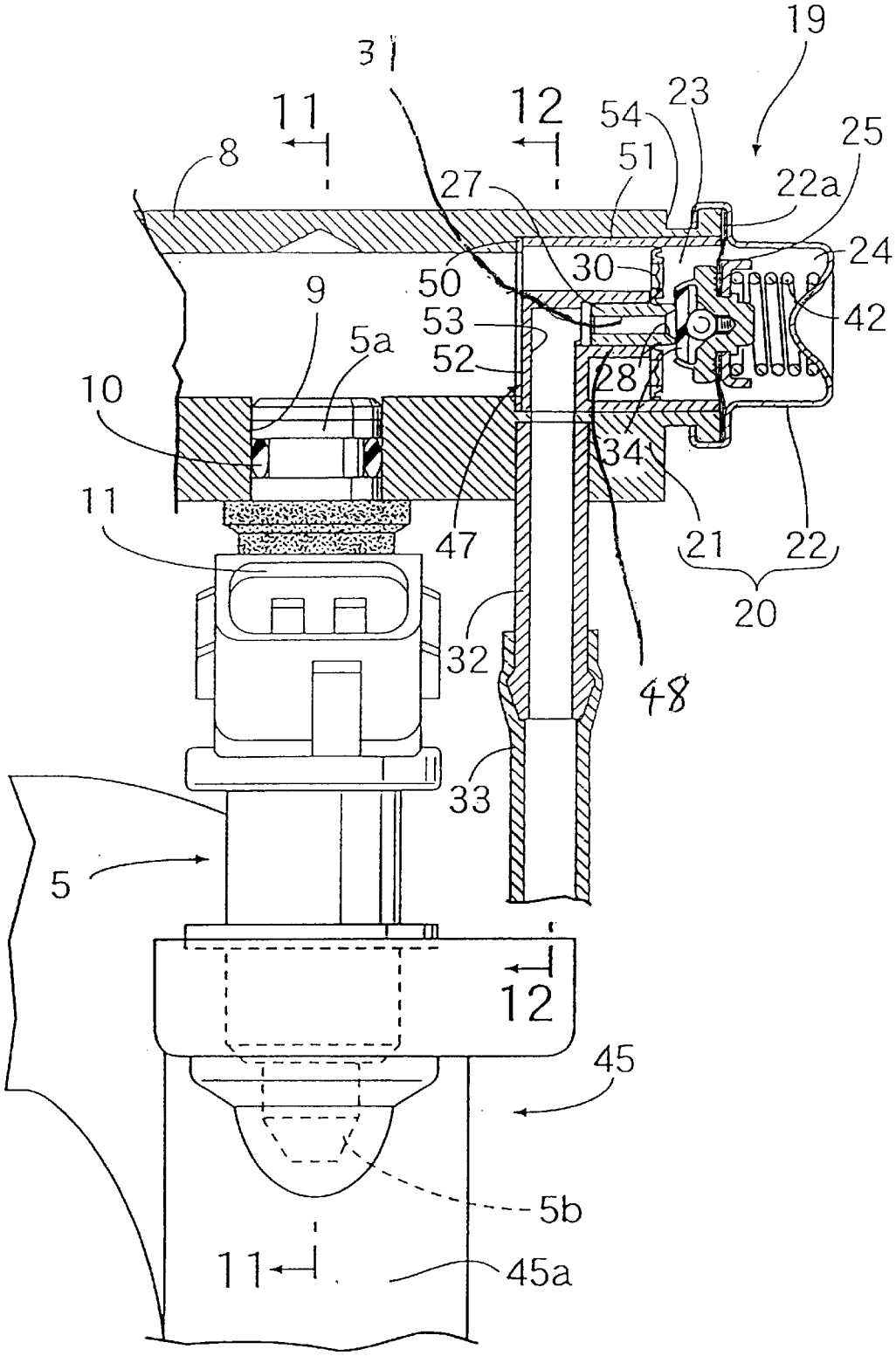
FIG. 9 is an enlarged, vertically sectional view of an essential part of the fuel injection device shown in FIG. 8.
Figure 10:
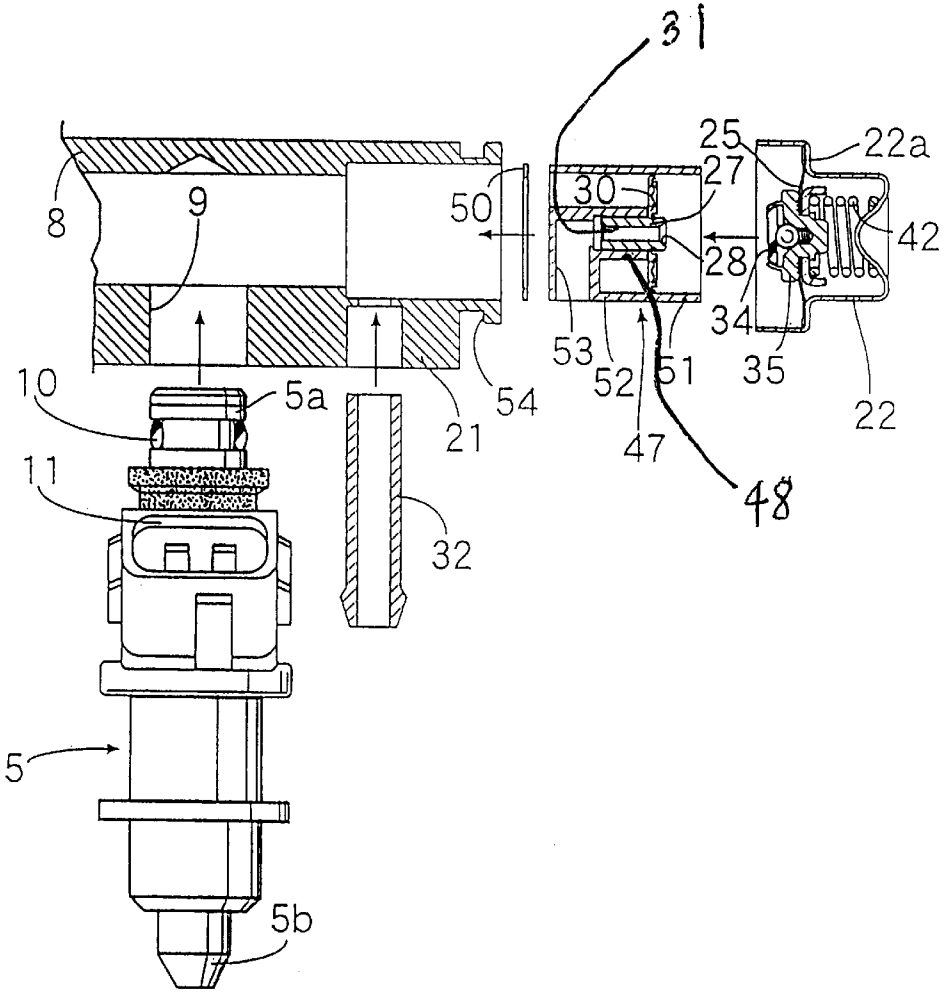
FIG. 10 is an exploded view of the essential part of the fuel injection device shown in FIG. 8.

A third preferred embodiment of the present invention will now be described with reference to FIG. 7.

The injection pressure regulator 19 in the third preferred embodiment has a conical valve seat 28 integral with the fuel supply pipe 8. In this preferred embodiment, the valve seat 28 is formed at the front end of the boss 26 serving as a valve seat member. The housing body 21 is also integral with the fuel supply pipe 8. The valve retainer 35 fixed to the diaphragm 25 is formed with a conical recess 37 opposed to the valve seat 28. A spherical valve element 34 is disposed in the conical recess 37 so as to be seated on the valve seat 28. The valve element 34 is elastically supported by a valve spring 43 inserted in the valve hole 31 under a given set load. The given set load of the valve spring 43 is much smaller than the set load of the pressure regulating spring 42. The valve element 34 and the boss 26 having the valve seat 28 constitute valve means 41 in the third preferred embodiment. The other configuration is similar to that of the first preferred embodiment, and corresponding parts are denoted by the same reference numerals in FIG. 7, whose description will be omitted herein.

In operation, when the fuel pressure in the fuel chamber 23 is less than or equal to a given value, the valve element 34 is kept seated on the valve seat 28 by the set load of the pressure regulating spring 42. When the fuel pressure in the fuel chamber 23 becomes greater than the given value to urge the diaphragm 25 to the pressure regulating chamber 24 side, the valve element 34 is separated from the valve seat 28 by the biasing force of the valve spring 43. As a result, an excess part of the fuel pressure in the fuel chamber 23 can be discharged from the fuel return outlet 32 as similarly to the first preferred embodiment.

According to the third preferred embodiment, the structure of the valve means 41 can be simplified to thereby contribute to a further reduction in cost.

A fourth preferred embodiment of the present invention will now be described with reference to FIGS. 8 to 14.

Figure 11:
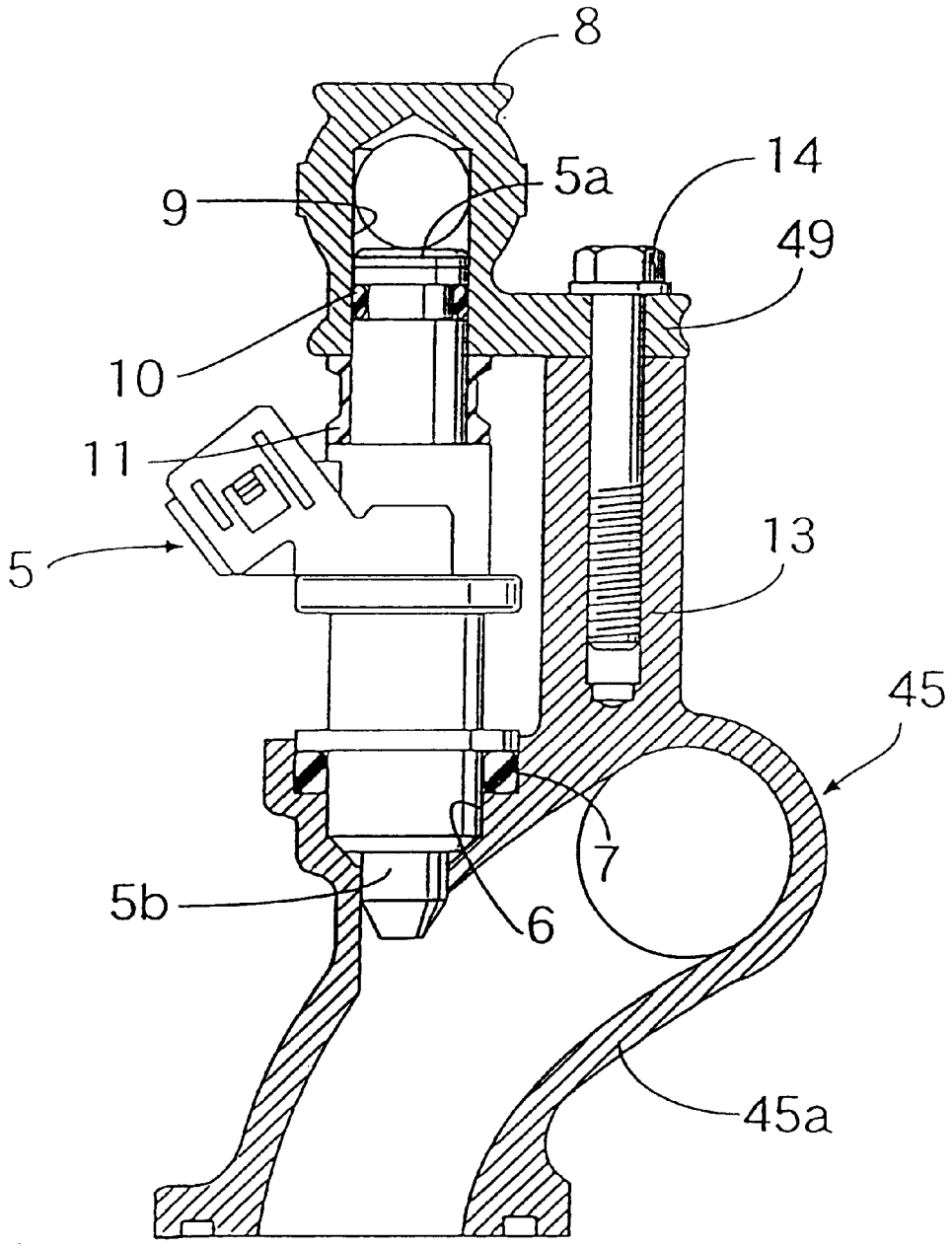
FIG. 11 is a cross-sectional view taken along the line 11—11 in FIG. 9.
Figure 12:
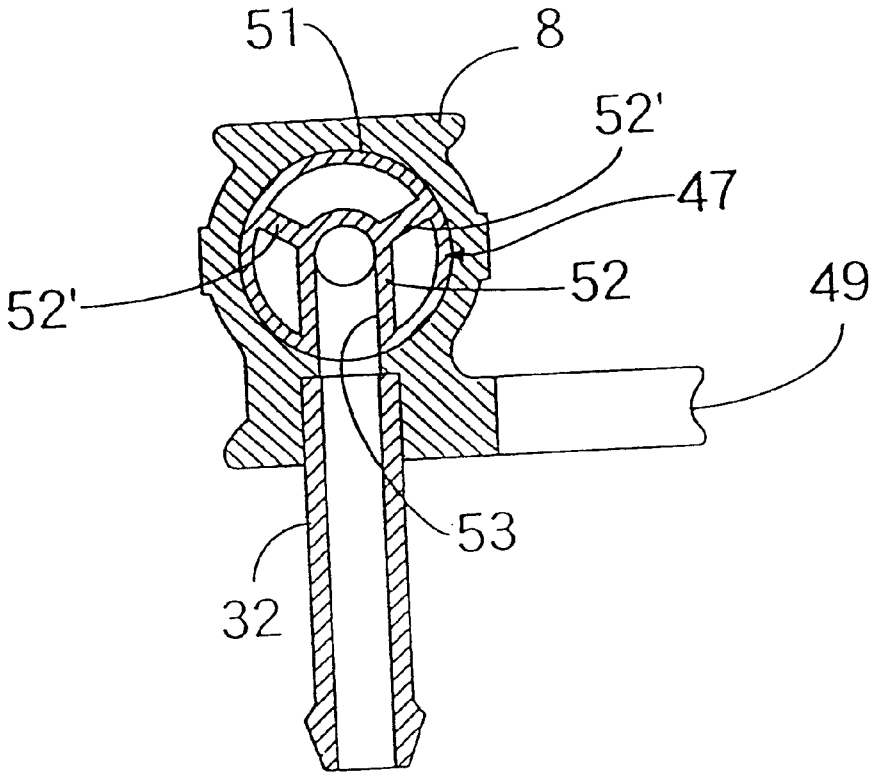
FIG. 12 is a cross-sectional view taken along the line 12—12 in FIG. 9.

Referring to FIGS. 8 to 11, fuel outlet portions 5*b* of a plurality of fuel injectors 5 are mounted on downstream end portions of a plurality of branch pipes 45*a* of an intake manifold 45 of a multicylinder engine (not shown), respectively. A common fuel supply pipe 8 for supplying fuel to these fuel injectors 5 is formed from an extruded member. Fuel inlet portions 5*a* of the fuel injectors 5 are fitted with a plurality of supply holes 9 formed through a lower wall of the fuel supply pipe 8, respectively. A common fuel feed pipe 17 is connected to one end of the fuel supply pipe 8, and a common injection pressure regulator 19 is provided at the other end of the fuel supply pipe 8. As shown in FIG. 11, the fuel supply pipe 8 is integrally formed with a shelf-like mounting bracket 49 projecting from a side wall of the fuel supply pipe 8 and extending in its axial direction. The mounting bracket 49 of the fuel supply pipe 8 is fixed by bolts 14 to supporting bosses 13 projecting upward from the intake manifold 45.

The other end portion of the fuel supply pipe 8 is enlarged in inner diameter by cutting the inner circumferential surface of the fuel supply pipe 8, thereby forming a housing body 21 of the injection pressure regulator 19. A cylindrical valve seat housing 47 is press-fitted with the inner circumferential surface of the housing body 21. A gasket 50 is interposed between the inner end of the valve seat housing 47 and the fuel supply pipe 8. Alternatively, a liquid packing may be applied to the press-fit surfaces of the valve seat housing 47 and the housing body 21. With this configuration, a reliable fluid-tight condition is ensured between the valve seat housing 47 and the housing body 21.

The valve seat housing 47 is composed of a cylindrical wall 51 press-fitted with the housing body 21, a plurality of arms 52 and 52' projecting radially inwardly from the inner circumferential surface of the cylindrical wall 51 and collected together at a radially central portion of the cylindrical wall 51, and a cylindrical boss 48 projecting axially outward from an end surface of the collected portion of the arms 52 and 52'. The arm 52 is formed as a thick-walled portion, and the arms 52' are formed as thin-walled portions. A cylindrical valve seat member 27 is press-fitted in the boss 48. The thick-walled arm 52 is formed with a radial communication hole 53 communicating with the valve hole 31 in the valve seat member 27. A fuel return outlet 32 communicating with the radial communication hole 53 is fixed to the circumferential wall of the housing body 21 by press-fit or the like.

An annular groove 54 is formed on the outer circumferential surface of an outer end portion of the housing body 21, and an outer end portion of the flange 22*a* of the cover 22 is fixedly engaged with the annular groove 54 by crimping in such a manner that a diaphragm 25 is held between the flange 22*a* and the end surface of the housing 21.

Figure 13:
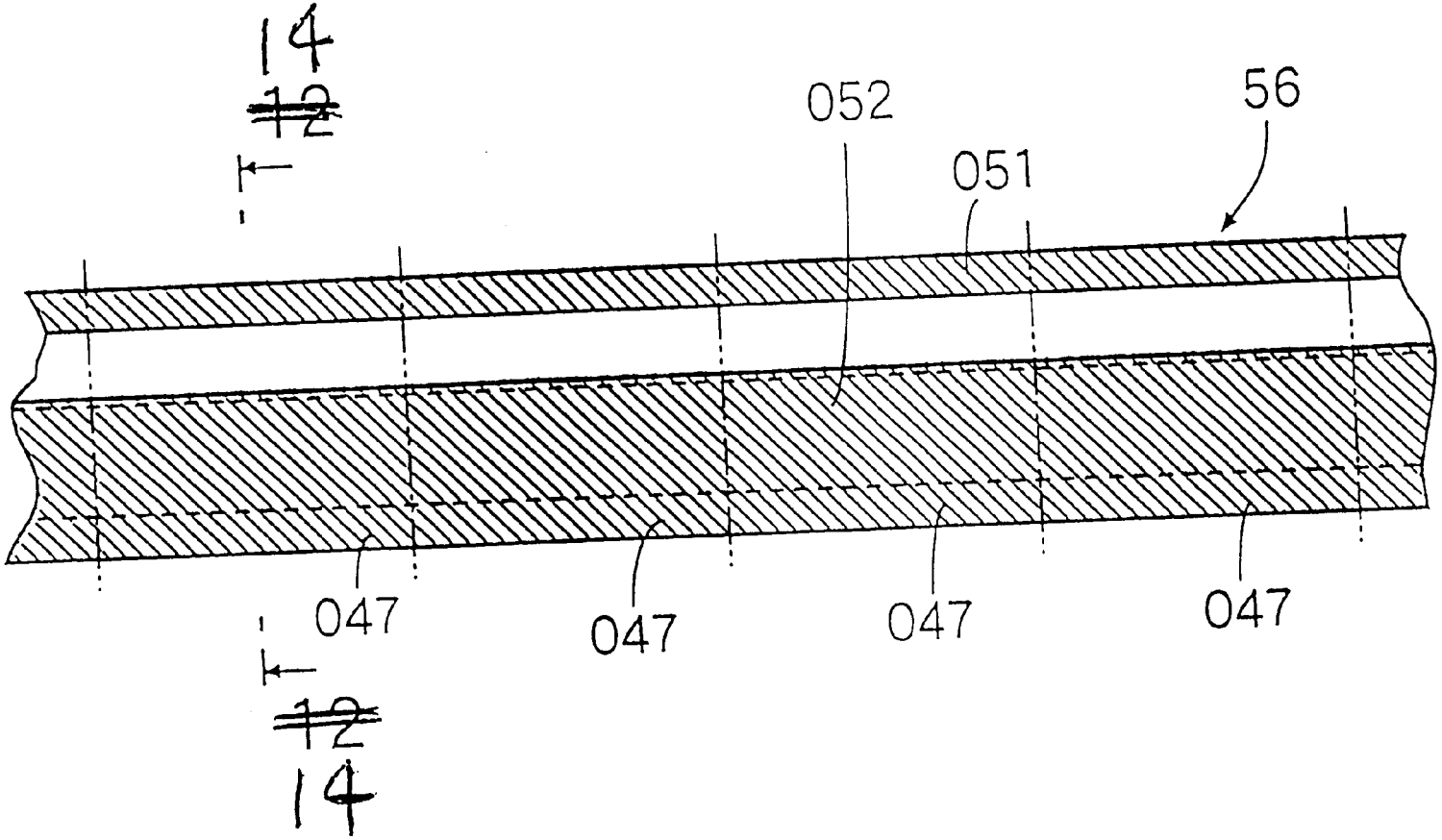
FIG. 13 is a vertically sectional view of an extruded pipe used as a blank for a valve seat housing.
Figure 14:
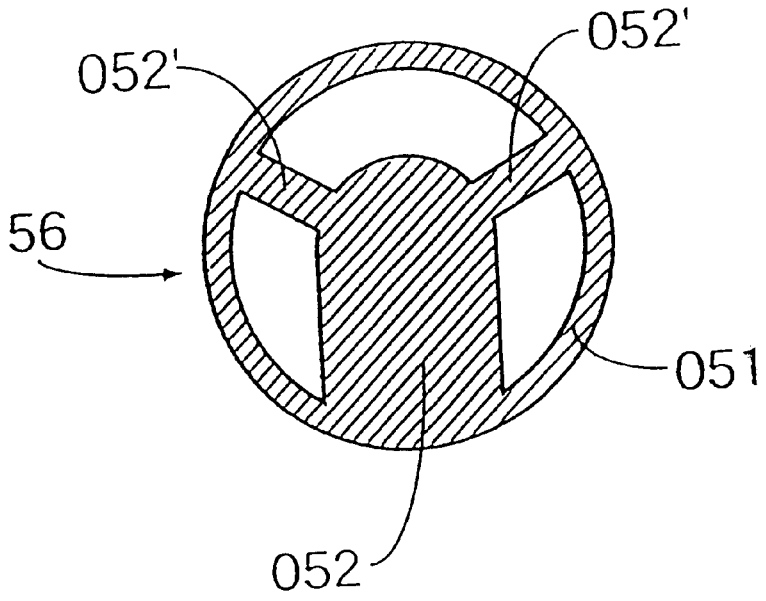
FIG. 14 is a cross-sectional view taken along the line 14—14 in FIG. 13.

The valve seat housing 47 is formed from an extruded member 56 as shown in FIGS. 13 and 14. The extruded member 56 consists of a cylindrical wall 051 corresponding to the cylindrical wall 51 of the valve seat housing 47 and a plurality of partition walls 052 and 052' respectively corresponding to the arms 52 and 52' of the valve seat housing 47. The extruded member 56 is cut in a direction perpendicular to its axis to prepare a plurality of valve seat housing blanks 047. The partition walls 052 and 052' of each valve seat housing blank 047 are suitably cut to obtain the valve seat housing 47.

The other configuration is similar to that of the first preferred embodiment, and corresponding parts are denoted by the same reference numerals in FIGS. 8 to 14, whose description will be omitted herein.

According to the fourth preferred embodiment mentioned above, the fuel supply pipe 8 integrally having the housing body 21 is formed from an extruded member, and the valve seat housing 47 to be press-fitted with the inner circumferential surface of the housing body 21 is also formed from an extruded member. Accordingly, mass production of parts can be made to thereby achieve the cost reduction. The fuel injection device of this preferred embodiment may be applied also to a single-cylinder engine. Further, the valve means 41 of the third preferred embodiment shown in FIG. 7 may be adopted as the valve means 41 of the fourth preferred embodiment.

Figure 15:
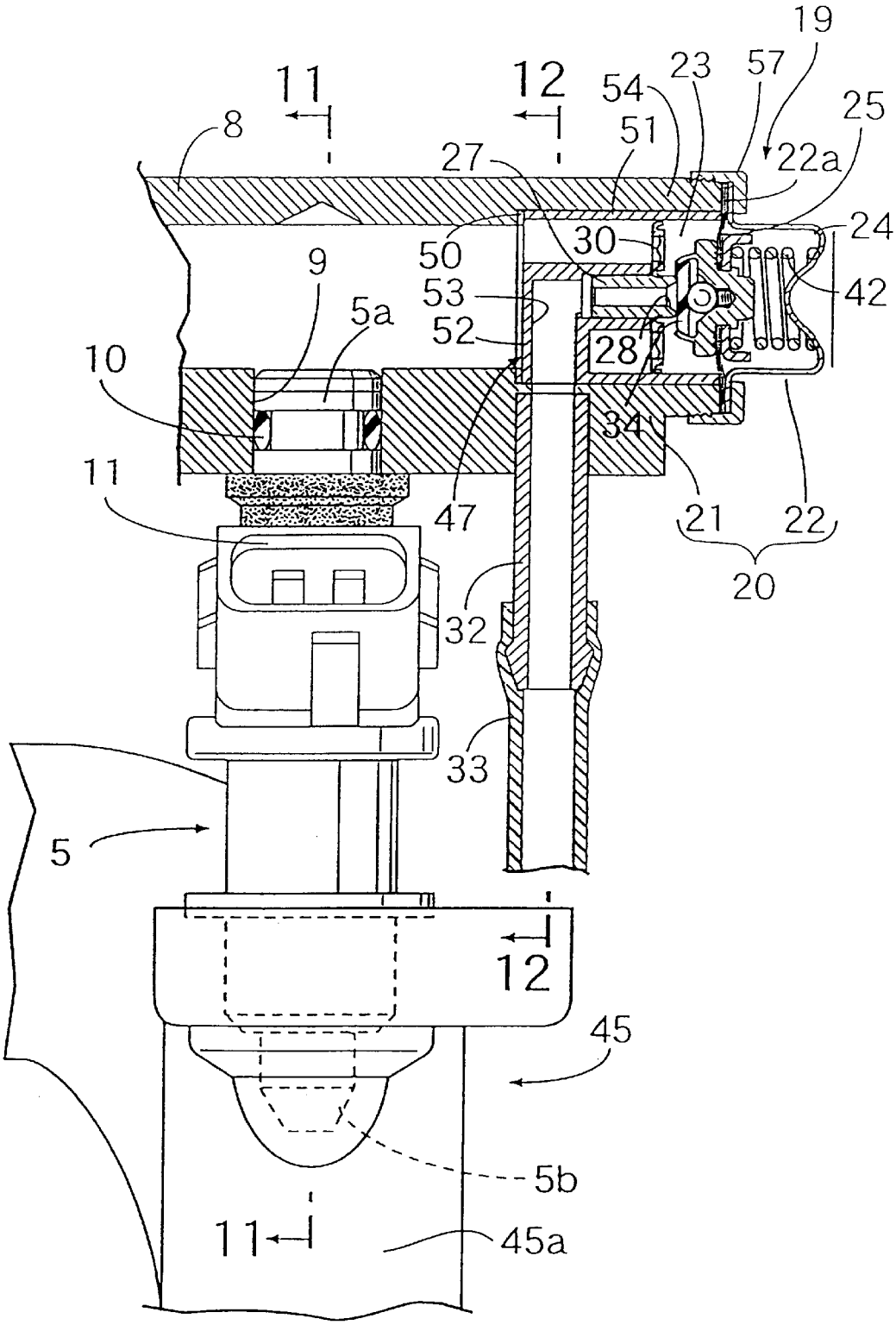
FIG. 15 is a sectional view similar to FIG. 9, showing a fifth preferred embodiment of the present invention.

FIG. 15 shows a fifth preferred embodiment of the present invention. This preferred embodiment is similar to the fourth preferred embodiment shown in FIG. 9 with the exception that a ring nut 57 is used for the connection of a housing body 21 and a cover 22, and corresponding parts are denoted by the same reference numerals in FIG. 15, whose description will be omitted herein.

The present invention is not limited to the above preferred embodiments, but various modifications may be made without departing from the scope of the present invention. For example, a boost vacuum in an engine may be induced into the pressure regulating chamber 24 of the injection pressure regulator 19 to thereby control the fuel pressure in the fuel chamber 23 according to an engine load.

According to the first aspect of the present invention, there is provided in a fuel injection device including a fuel supply pipe; a fuel feed pipe communicating with a fuel pump and connected to one end portion of the fuel supply pipe; an injection pressure regulator provided at the other end portion of the fuel supply pipe, the injection pressure regulator includes a regulator housing, a diaphragm partitioning the regulator housing into a fuel chamber communicating with the fuel supply pipe and a pressure regulating chamber. A pressure regulating biasing means is provided in the pressure regulating chamber for biasing the diaphragm toward the fuel chamber. A valve means is adapted to close at a limit of displacement of the diaphragm toward the fuel chamber and to open in concert with displacement of the diaphragm from the limit toward the pressure regulating chamber, and a fuel return outlet communicating with the fuel chamber through the valve means. A fuel injector is fitted with a supply hole formed through a circumferential wall of the fuel supply pipe. The regulator housing is divided into a housing body defining the fuel chamber therein and a cover defining the pressure regulating chamber, and the housing body is integral with the fuel supply pipe. With this configuration, the fuel supply pipe and the housing body are integrally formed, so that it is not necessary to provide any connecting means for connecting the fuel supply pipe and the regulator housing as in the prior art, thus greatly reducing the number of parts in the fuel injection device to thereby achieve the cost reduction.

According to the second aspect of the present invention, the valve means comprises a valve seat formed in the fuel supply pipe and a valve element attached to the diaphragm and adapted to be seated on the valve seat, and the fuel return outlet communicating with the valve seat is integral with the fuel supply pipe. With this configuration, the fuel supply pipe and the fuel return outlet are also integrally formed, so that the number of parts can be further reduced to thereby achieve a further reduction in cost.

According to the third aspect of the present invention, there is provided in a fuel injection device including a fuel supply pipe; a fuel feed pipe communicating with a fuel pump and connected to one end portion of the fuel supply pipe; an injection pressure regulator provided at the other end portion of the fuel supply pipe, the injection pressure regulator includes a regulator housing, a diaphragm partitioning the regulator housing into a fuel chamber communicating with the fuel supply pipe and a pressure regulating chamber. A pressure regulating biasing means is provided in the pressure regulating chamber for biasing the diaphragm toward the fuel chamber. A valve means is adapted to close at a limit of displacement of the diaphragm toward the fuel chamber and to open in concert with displacement of the diaphragm from the limit toward the pressure regulating chamber. A fuel return outlet is communicating with the fuel chamber through the valve means; and a fuel injector fitted with a supply hole is formed through a circumferential wall of the fuel supply pipe. The fuel supply pipe is formed from an extruded member. The regulator housing includes a housing body defining the fuel chamber therein and formed at the other end portion of the fuel supply pipe. A valve seat housing is mounted in the housing body and formed from an extruded member. A cover defining the pressure regulating chamber therein is joined to the housing body with the diaphragm held between the housing body and the cover. The valve seat housing includes a cylindrical wall fitted with an inner circumferential surface of the housing body and an arm projecting from an inner circumferential surface of the cylindrical wall to a radially central portion thereof. The valve means includes a valve seat formed on the arm so as to be exposed to the fuel chamber, and a valve element attached to the diaphragm and adapted to be seated on the valve seat. The arm is formed with a radial communication hole for making communication between the valve seat and the fuel return outlet fixed to the housing body. With this configuration, the fuel supply pipe and the housing body are integrally formed, so that it is not necessary to provide any connecting means for connecting the fuel supply pipe and the regulator housing as in the prior art, thereby greatly reducing the number of parts in the fuel injection device to result in cost reduction. Moreover, the fuel supply pipe and the valve seat housing are formed from the respective extruded members, so that a further reduction in cost can be achieved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. In a fuel injection device comprising:

a fuel supply pipe;

a fuel feed pipe communicating with a fuel pump and connected to one end portion of said fuel supply pipe;

an injection pressure regulator is provided at the other end portion of said fuel supply pipe, said injection pressure regulator comprising:

a regulator housing;

a diaphragm partitioning said regulator housing into a fuel chamber communicating with said fuel supply pipe and a pressure regulating chamber;

pressure regulating biasing means provided in said pressure regulating chamber for biasing said diaphragm toward said fuel chamber;

valve means adapted to close at a limit of displacement of said diaphragm toward said fuel chamber and to open in concert with displacement of said diaphragm from said limit toward said pressure regulating chamber; and a fuel return outlet communicating with said fuel chamber through said valve means; and a fuel injector fitted with a supply hole formed through a circumferential wall of said fuel supply pipe;

said regulator housing being divided into a housing body defining said fuel chamber therein and a cover defining said pressure regulating chamber, and said housing body formed integrally with said fuel supply pipe.

2. The fuel injection device according to claim 1, wherein said valve means includes a valve seat formed in said fuel supply pipe and a valve element attached to said diaphragm and adapted to be seated on said valve seat, and said fuel return outlet communicating with said valve seat is integral with said fuel supply pipe.

3. In a fuel injection device comprising:

a fuel supply pipe;

a fuel feed pipe communicating with a fuel pump and connected to one end portion of said fuel supply pipe;

an injection pressure regulator is provided at the other end portion of said fuel supply pipe, said injection pressure regulator comprising:

a regulator housing;

a diaphragm partitioning said regulator housing into a fuel chamber communicating with said fuel supply pipe and a pressure regulating chamber;

pressure regulating biasing means provided in said pressure regulating chamber for biasing said diaphragm toward said fuel chamber;

valve means adapted to close at a limit of displacement of said diaphragm toward said fuel chamber and to open in concert with displacement of said diaphragm from said limit toward said pressure regulating chamber;

a fuel return outlet communicating with said fuel chamber through said valve means; and a valve retainer is mounted on said valve means, said valve retainer including a valve element operatively mounted therein for seating with a valve seat and a biasing means operatively positioned relative to said valve element for biasing said valve element relative to said valve seat; and a fuel injector fitted with a supply hole formed through a circumferential wall of said fuel supply pipe;

said regulator housing being divided into a housing body defining said fuel chamber therein and a cover defining said pressure regulating chamber, and said housing body is integral with said fuel supply pipe.

4. The fuel injection device according to claim 3, and further including a ball member biased towards said valve element.

5. The fuel injection device according to claim 3, wherein said valve element is slidably mounted within a boss for selectively supplying fuel to said fuel return outlet.

6. The fuel injection device according to claim 5, and further including a fuel filter operatively mounted on said valve element and positioned relative to said fuel supply pipe for filtering fuel supplied to said fuel chamber.

7. In a fuel injection device comprising:

a fuel supply pipe;

a fuel feed pipe communicating with a fuel pump and connected to one end portion of said fuel supply pipe;

an injection pressure regulator provided at the other end portion of said fuel supply pipe, said injection pressure regulator comprising:

a regulator housing;

a diaphragm partitioning said regulator housing into a fuel chamber communicating with said fuel supply pipe and a pressure regulating chamber;

pressure regulating biasing means provided in said pressure regulating chamber for biasing said diaphragm toward said fuel chamber;

valve means adapted to close at a limit of displacement of said diaphragm toward said fuel chamber and to open in concert with displacement of said diaphragm from said limit toward said pressure regulating chamber; and a fuel return outlet communicating with said fuel chamber through said valve means; and a fuel injector fitted with a supply hole formed through a circumferential wall of said fuel supply pipe;

said fuel supply pipe is formed from an extruded member;

said regulator housing comprising:

a housing body defining said fuel chamber therein and formed at said other end portion of said fuel supply pipe;

a valve seat housing mounted in said housing body and formed from an extruded member; and a cover defining said pressure regulating chamber therein and joined to said housing body with said diaphragm held between said housing body and said cover;

said valve seat housing comprising:

a cylindrical wall fitted with an inner circumferential surface of said housing body and an arm projecting from an inner circumferential surface of said cylindrical wall to a radially central portion thereof;

said valve means comprising:

a valve seat formed on said arm so as to be exposed to said fuel chamber, and a valve element attached to said diaphragm and adapted to be seated on said valve seat; and said arm is formed with a radial communication hole for making communication between said valve seat and said fuel return outlet fixed to said housing body.

8. The fuel injection device according to claim 7, wherein said valve means is adapted to be seated on said valve seat and said fuel return outlet communicating with said valve seat is detachably mounted relative to said fuel supply pipe.

9. The fuel injection device according to claim 7, wherein a valve retainer is mounted on said valve means, said valve retainer includes said valve element operatively mounted therein for seating with said valve seat and a biasing means operatively positioned relative to said valve element for biasing said valve element relative to said valve seat.

10. The fuel injection device according to claim 9, and further including a ball member biased towards said valve element.

11. The fuel injection device according to claim 9, wherein said valve element is slidably mounted within a boss for selectively supplying fuel to said fuel return outlet.

12. The fuel injection device according to claim 11, and further including a fuel filter operatively mounted on said valve element and positioned relative to said valve seat housing for filtering fuel supplied to said fuel chamber.

* * * * *